United States Patent [19]

Klaiber et al.

[11] 4,248,124

[45] Feb. 3, 1981

[54] PIANO SOUNDBOARD

[75] Inventors: George S. Klaiber, Tonawanda, N.Y.; Stanley A. Grajek, DeKalb, Ill.; Robert S. Hill, Holly Springs, Miss.

[73] Assignee: The Wurlitzer Company, DeKalb, Ill.

[21] Appl. No.: 969,722

[22] Filed: Dec. 15, 1978

[51] Int. Cl.[3] ..... G10C 3/06

[52] U.S. Cl. ..... 84/192; 84/195; 84/212

[58] Field of Search ..... 84/192–196

[56] References Cited

U.S. PATENT DOCUMENTS

| | | | |
|---|---|---|---|
| 2,674,912 | 4/1954 | Petek | 84/291 |
| 3,641,861 | 2/1972 | Andersen | 84/192 |
| 3,724,312 | 4/1973 | Yamada et al. | 84/193 |
| 4,155,284 | 5/1979 | Graves | 84/192 X |

FOREIGN PATENT DOCUMENTS

| | | | |
|---|---|---|---|
| 581954 | 10/1946 | United Kingdom | 84/193 |

*Primary Examiner*—Lawrence R. Franklin

*Attorney, Agent, or Firm*—Trexler, Wolters, Bushnell & Fosse, Ltd.

[57] ABSTRACT

A soundboard for pianos is provided which is of laminated construction, comprising three plies. The top and bottom plies are of equal thickness and lie in planes parallel to one another. The grains of these plies are also parallel to one another. The center ply is of greater thickness than the sum of the outer plies, but of less thickness than twice the sum of the two outer plies. The grain of the center or core ply is at right angles to the grains of the two outer plies.

3 Claims, 6 Drawing Figures

PIANO SOUNDBOARD

BACKGROUND OF THE INVENTION

Pianos have been built for centuries with soundboards constructed of wood. It is known that a relatively close grained wood is the best for soundboards. It has been conventional in the United States to use Sitka spruce boards of an appropriate thickness and edge-glued together to make up the necessary width of the board.

It is known that the velocity of sound in a solid material is equal to the square root of the elasticity divided by the density. Thus, for best sound propagation the elasticity should be high and the density should be low. Most woods are not suitable for soundboards either because the elasticity is too low or the density is too high. Conventional spruce or pine is not satisfactory since the growth is too fast, and the grain too open. Hence, the density and elasticity are not appropriate. The specific spruce suitable for the construction of solid piano sounding boards is grown under somewhat adverse climatic conditions, whereby the growth is slow, and the grain closely spaced.

Spruce boards for piano soundboards are quarter sawn. Accordingly, a board can be no wider than the radius of a tree. The center and the sapwood must be avoided, whereby the width of such boards is limited. It must also be borne in mind that knots, grain swirls, etc. must be avoided. The preferred grain spacing corresponds to something close to ten annular rings per inch. From this it is easy to see that only very old trees can have any appreciable thickness of boards made from them. As a result of this and other factors the supply of suitable spruce boards is shrinking.

Conventional piano soundboards have an inherent disadvantage in that sound travels fastest in the direction of the grain. In fact, the speed in the grain direction of a conventional solid spruce soundboard is about four times as fast as it is transverse of the grain.

Some effort has been made in the past to construct soundboards of laminated plies. Such efforts have not met with success, as the boards have failed to resonate properly, and have sounded dull or "tubby".

OBJECTS AND SUMMARY

It is an object of the present invention to provide an improved laminated soundboard for pianos.

More particularly, it is an object of the present invention to provide such a laminated soundboard preferably made of spruce, which is musically substantially the full equivalent of conventional solid soundboards while presenting the advantages of laminated construction, including more efficient use of supply, and absence of cracking, warping, and splitting.

To attain these ends a soundboard is made of laminated construction of specific dimensions in grain orientation. Three plies only are used, with the outer two plies being of equal thickness, namely 0.050 in., and the center ply being of greater thickness, namely 0.166 in. The total thickness thus is 0.266 as a sum of the thickness, but the final thickness is actually slightly less as the board is mechanically compressed during lamination. The two outer plies have their grains oriented parallel to one another, while the center ply has its grain oriented at right angles to the outer plies.

DESCRIPTION OF THE DRAWINGS

The present invention will best be understood with reference to the following specification when taken in connection with the accompanying drawings wherein.

DETAILED DESCRIPTION

Figure 1:
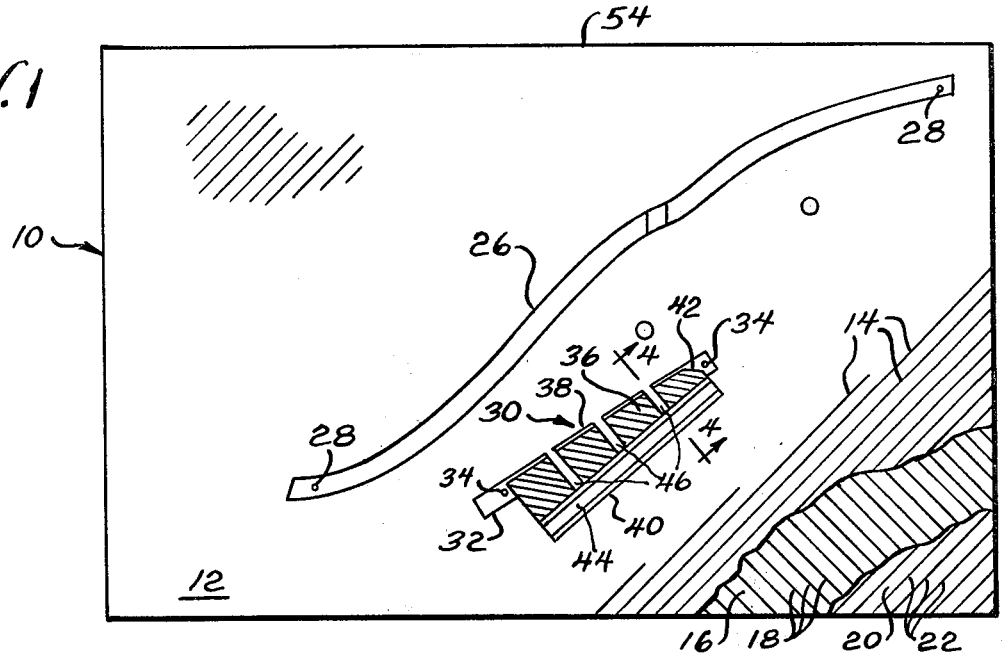
FIG. 1 is a front view of a soundboard constructed in accordance with the present invention, with portions being broken away in one corner to show ply orientation.
Figure 2:
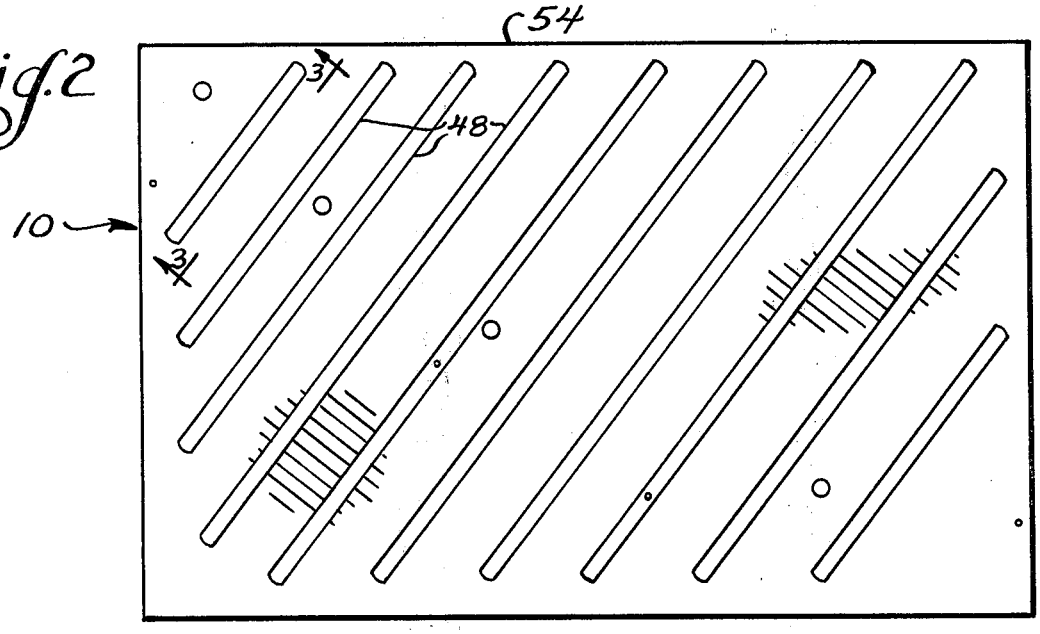
FIG. 2 is a back view of the soundboard of FIG. 1.

Referring now in greater particularity to the drawings, and first to FIGS. 1 and 2, there is shown a soundboard 10 constructed in accordance with the present invention, and of rectangular outline and proper size for incorporation in an upright piano. The soundboard is of laminated construction (see also FIGS. 3 and 4) and includes an upper layer or ply 12 of 0.050 inch thickness and with the grain running at substantially forty-five degrees up to the right as shown at 14 at the lower right hand corner of FIG. 1. The center ply 16 is of 0.166 inch thickness and has the grain 18 running at forty-five degrees up to the left, i.e., at right angles to the grain 14 of the upper or outer ply. The rear or bottom ply 20 is of 0.050 inch thickness, the same as the top or front ply, and the grain thereof runs parallel to the top grain as shown at 22 in FIG. 1. The relative orientation of the ply grains as set forth is very important. Although the specific absolute angles at 45° is preferred, it is not essential. Each ply consists of random width strips a few inches in width as best seen at 24 in FIGS. 3 and 4. The plies are secured together by a urea formaldehyde glue, and gluing is effected under pressure with steam heated platens or plates to set the glue. The glue penetrates the wood to a certain extent as is the usual practice in gluing.

On the front the soundboard 10 is provided with a treble bridge 26 secured to the soundboard by screws 28 at the opposite ends and throughout its extremity by gluing. The glue used for securing the bridge is preferably a catalyzed polyvinyl glue, with the bridge applied and glue applied at room temperature in a jig or fixture, and allowed to set for about 24 hours after removal from the fixture in which the soundboard and bridge remain for only a short time. The piano strings are not shown, as they do not differ from conventional practice, and it will be understood that the treble strings run upwardly to the right at an angle between forty-five and ninety degrees.

The soundboard is provided also with a bass bridge 30 positioned and oriented as shown in FIG. 1. The bass bridge (see also FIG. 4) includes a runner 32 secured by screws 34 relatively adjacent its opposite ends, and also glued to the soundboard by means of a catalyzed polyvinyl glue. The bridge also includes an apron or plate 36 comprising a board having its long edge 38 glued on top of the runner 32. The rest of the apron is cantilevered out from the runner 32 and includes an oppositely disposed long edge 40 skewed somewhat relative to the edge 38, by an order of a few degrees. The edges 38 and 40 are closer together at the treble end than relatively toward the bass end of the soundboard. The uppermost corner of the apron 36 is removed diagonally as shown at 42.

The bridge also includes a bridge cap 44 glued to the upper surface of the apron along the long edge 40. As may be seen best in FIG. 4 the bridge cap is of trapezoidal cross-section, being somewhat wider at its glued attachment to the apron than at its upper free edge. Again, a catalyzed polyvinyl glue is used.

An important feature of the bass bridge is that the apron is provided with three slots 46 therein extending completely through the apron and the runner oriented at right angles to the free edge 40. In accordance with the traditional overstringing of the bass strings the bass strings run substantially at right angles to the bridge cap 44. The desirability of the slots 46 has been determined empirically, the sound of the bass strings being greatly superior with the slots as compared to a similar construction without the slots. It is believed that the bridge has improved flexibility with the slots in the apron, and it is this improved flexibility that has improved the bass reproduction.

Figure 3:
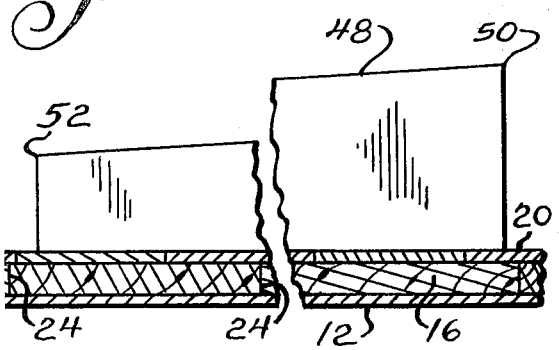
FIG. 3 is a sectional view taken substantially along the line 3—3 in FIG. 2.
Figure 4:
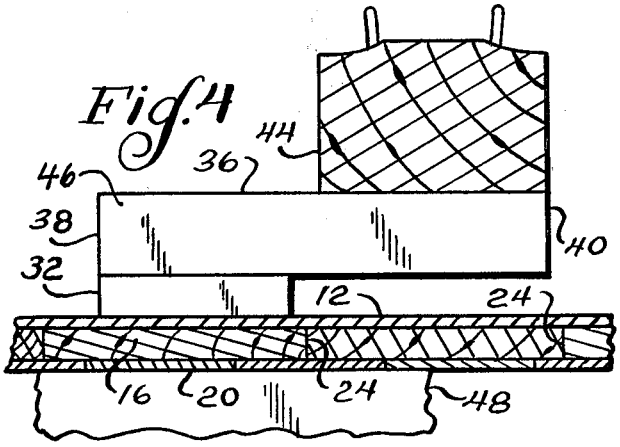
FIG. 4 is a cross-sectional view on an enlarged scale taken substantially along the line 4—4 in FIG. 1.

On the back of the soundboard, see particularly FIGS. 2 and 3, there are reinforcing ribs 48 in parallel spaced relation, and of maximum length as illustrated. The ribs run diagonally up to the right, i.e. generally perpendicular to the treble bridge 26 and the bass bridge 30. The ribs are glued to the surface of the soundboard by the catalyzed polyvinyl glue mentioned heretofore, and materially enhance the rigidity and sound transmission properties of the soundboard. The ribs 48 depart significantly from conventional construction. Conventional ribs are gained or scalloped on the outer portions of the ends thereof, which has been determined empirically to produce better sound results. However, with the present laminated board exactly the opposite has been found to be true. The ribs are provided with full height, nearly right angle outer ends.

Figure 5:
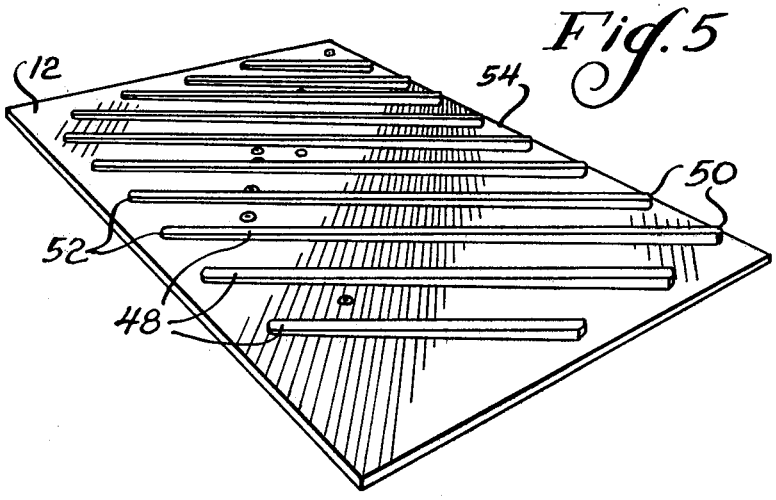
FIG. 5 is a perspective view of the back of the soundboard.

As may be seen in FIG. 3 and better in FIG. 5, each of the ribs 48 has a maximum height at the upper end thereof at 50 and tapering uniformally down to a minimum height 52 at the lower end thereof. The ribs 48 are also crowned at the outer surface. In the longer ribs the height out from the board at the upper corner 50 is 13/16", while they taper to 3/16" at the bottom. With this tapering of ribs and the almost square upper corners thereof glued to a flat laminated board, results are obtained similar to those obtained in conventional or solid soundboards which have a taper built into them. Specifically, a typical solid spruce board of the size here in question tapers in thickness from 5/16" at the top to 3/16" at the bottom. The tapered board in the prior art, and the tapered ribs here provide somewhat better treble response. In the perspective view of FIG. 5 it will be apparent that the long edge at the upper right portion of the figure, identified by numeral 54 is the top edge of the soundboard.

Figure 6:
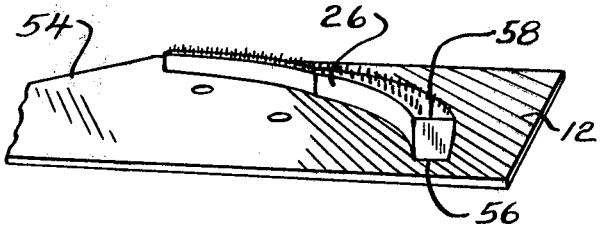
FIG. 6 is a perspective view of the front of the soundboard.

In FIG. 6, the top edge 54 of the soundboard now being at the upper left, the treble bridge 26 at each end tapers outwardly from a narrower transverse dimension at its back surface 56 to an outer or free surface 58, the intermediate cross section being rectangular. Also, the ends are tapered longitudinally of the treble bridge. It has been found empirically that these tapers provide a better sound quality as compared with a bridge having uniform dimensions.

At this point certain observations or emphasis appear to be in order in addition to details heretofore noted. For one thing, in accordance with the present invention, it is essential that there be three plies, no more, and no less. Furthermore, the thickness of the plies should be as noted, within normal woodworking tolerances. The relative dimensions, whereby the outer layers are the same, and the inner layer or ply is thicker than the two outer layers together is known empirically to be of considerable importance. In theory, it is believed that this is due to the fact that the effect of a given ply on the flexural rigidity of a laminated board increases as the distance of the ply from the central plane of the board increases. Thus to attain a flexural rigidity of the board in the direction of the grain of the wood in the outer plies comparable to the rigidity of the board in the direction of the grain of the inner ply, the total thickness of the two outer plies would have to be less than the thickness of the inner ply. The thickness relationship, along with the direction of orientation of the grain of the various plies produces sound transmission which is very nearly equal in all directions, and hence much more efficient than is true in the conventional solid soundboard.

Although the all spruce construction as disclosed herein is preferable, other types of wood have been used with generally satisfactory results. For example, we have used poplar on a spruce core, and have also used mahogany or luan. It has been observed that the thickness of the center ply is greater than that of the front and back plies together, but it should be observed that this thickness is less than twice the sum of the front and back ply thicknesses.

The specific example of the present invvention as herein shown and described is for illustrative purposes. Various changes in structure will no doubt occur to those skilled in the art, and will be understood as forming a part of the present invention insofar as they fall within the spirit and scope of the appended claims.

The invention is claimed as follows:

1. A piano soundboard construction of substantially uniform thickness throughout and consisting of three plies only of wood bonded together, the front and back plies being of equal thickness and the center ply being of greater thickness than the sum of front and back ply thicknesses, the thickness of the center ply being less than twice the thickness of the front and back plies together, and the grains of the two outer plies being parallel to one another and the grain of the center ply being at right angles to the front and back ply grains, and a plurality of parallel diagonal ribs on said back ply, each of said ribs tapering from a greater height at the terminal end closest to the top of the soundboard to a lesser height at the terminal end closest to the bottom of the soundboard, and each terminal end presenting substantially the full height of the rib at that end.

2. A piano soundboard construction as set forth in claim 1 and further including a treble bridge and a bass bridge secured to said front ply and both substantially parallel to the grain of said front ply.

3. A piano soundboard construction as set forth in claim 2 with the ribs on said back ply substantially perpendicular to said bridges.

* * * * *